US008631610B2

(12) United States Patent
Willert

(10) Patent No.: US 8,631,610 B2
(45) Date of Patent: Jan. 21, 2014

(54) GUTTER PROTECTOR AND SYSTEM FOR ATTACHING THE SAME TO ROOFS

(76) Inventor: Wayne Willert, Port Washington, NY (US)

( * ) Notice: Subject to any disclaimer, the term of this patent is extended or adjusted under 35 U.S.C. 154(b) by 2268 days.

(21) Appl. No.: 11/495,059

(22) Filed: Jul. 28, 2006

(65) Prior Publication Data

US 2008/0022605 A1 Jan. 31, 2008

(51) Int. Cl.
*E04D 13/064* (2006.01)

(52) U.S. Cl.
USPC ..... 52/12; 52/546; 52/714; 24/570; 24/703.1

(58) Field of Classification Search
USPC ..... 52/11, 12, 712, 714, 546, 547, 551, 97; 24/570, 563, 910, 703.1
See application file for complete search history.

(56) References Cited

U.S. PATENT DOCUMENTS

| | | | | | |
|---|---|---|---|---|---|
| 1,356,930 | A | * | 10/1920 | McCord, Jr. | 52/420 |
| 2,138,320 | A | * | 11/1938 | Bozalina | 52/546 |
| 2,495,303 | A | * | 1/1950 | Wisniewski | 52/468 |
| 3,646,717 | A | * | 3/1972 | Parker | 52/548 |
| 4,032,456 | A | * | 6/1977 | Berce | 210/474 |
| 5,884,447 | A | * | 3/1999 | Earp | 52/489.1 |
| 5,966,893 | A | * | 10/1999 | Quillin | 52/713 |

FOREIGN PATENT DOCUMENTS

AU 9670548 A * 5/1998

* cited by examiner

*Primary Examiner* — Adriana Figueroa
(74) *Attorney, Agent, or Firm* — Tutunjian & Bitetto, P.C.

(57) ABSTRACT

A system for attaching gutter protection systems to roofs having shingle/tile like style. A roof clip is adapted to be positioned under a shingles such that a tab extends vertically upward through a keyway between two adjacent roof shingles. The tab receives and secures an upper end of the gutter protection system. The tab is folded over the gutter protector and secured to the based of the roof clip through the keyway.

6 Claims, 5 Drawing Sheets

GUTTER PROTECTOR AND SYSTEM FOR ATTACHING THE SAME TO ROOFS

BACKGROUND OF THE INVENTION

1. Field of the Invention

The present invention relates to gutter protection systems for preventing debris from clogging the same. More particularly it relates to a system for attaching gutter protection systems to roofs where the gutter protection system cannot be slid up under the first layer or more of roofing shingles.

2. Description of the Prior Art

Gutter protection systems are commonly known and come if a variety of different styles and designs. Generally, the purpose of a gutter protection system is to minimize and/or eliminate the possibility of leaves or other debris from entering a gutter and thereby preventing the same from operating for its intended purpose. These add-on gutter protection systems usually adhere to the front lip of the gutter and slide up under the last roof shingle so as to take the water run off the roof and direct it into the gutter.

Regardless of the design of these different gutter protection systems, they all suffer from one shortfall. That is, they cannot be installed on structures that have a slate or wood shingle type roofs, or any other roof where there is an obstruction under a row of shingles. The reason for this is simply that there is not enough flexibility or tolerance in the roofing shingle (e.g., slate or wood) or nails or other fasteners interfere and prevent the gutter protection system from sliding up under the last row of roof shingle that over hangs into the gutter.

As a result, homes or structures with slate roofs are left with exposed gutters which are subject to annual cleaning, which creates a dangerous condition for homeowners on ladders.

Thus, it will be apparent there is a need for a system that allows gutter protection systems to be connected to homes or structures having roofs where there is little or no room for the gutter protection system to be fastened there under.

SUMMARY OF THE INVENTION

The device for connecting a gutter protection system to a roof includes a roof clip having a flat portion and a tab portion substantially perpendicularly disposed with respect to the flat portion. The tab portion forms a notch for receiving an upper end of the gutter protection system.

In accordance with various aspects of the present principles, the roof clip has an an increased thickness along one edge of the same, where the increased thickness is disposed along the edge aligned with the tab portion.

The tab portion is adapted to fit between a keyway between two adjacent roofing shingles on the roof, said tab portion being secured the end of the gutter protection system.

In accordance with a further embodiment, the roof clip includes a fastening means for fastening the tab portion to the flat portion through the keyway between adjacent shingles A method for connecting a gutter protection system to a roof includes: inserting a roof clip under two adjacent shingles on a roof, said roof clip having an upward extension positioned in a keyway between the two adjacent shingles such that said upward extension protrusion, positioning an upper end of the gutter protection system on top of the roof shingles such that the upper end sits under the upward extension of the roof clip, securing the upward extension of the roof clip down onto the upper end of the gutter protection system; and inserting a fastener into the upward extension, through the upper end of the gutter protector and into a base of said roof clip.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
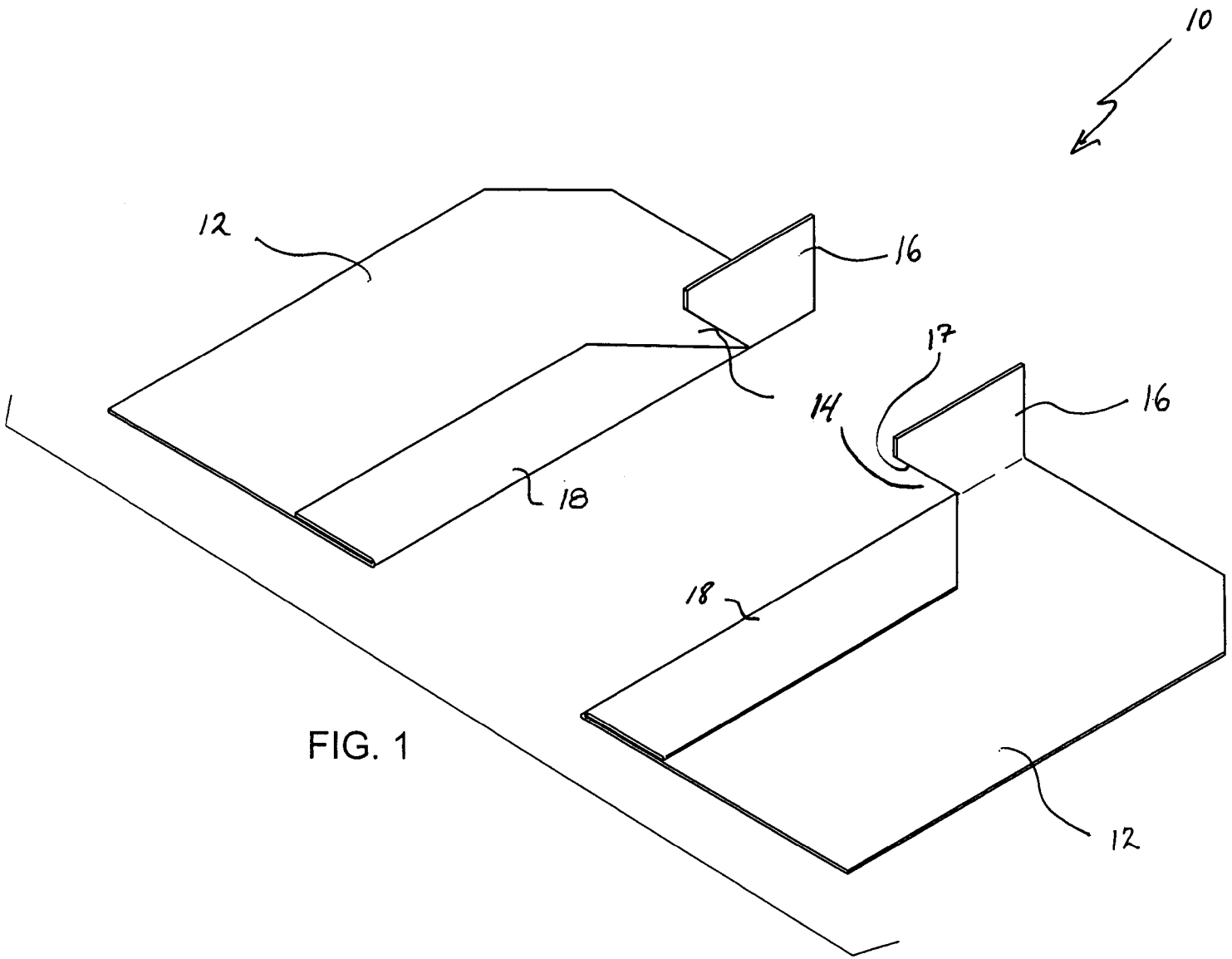
FIG. 1 is perspective view of the roof clips for securing a gutter protection system to a structure with a slate roof, according to an embodiment of the present principles.

FIG. 1 shows the roof clips 10 according to an embodiment of the present principles. The roof clips have a flat portion 12 that includes a folder over portion 18. The folded over portion 18 provides additional integrity and strength to the roof clip 12 without increasing the overall thickness of the same in any significant way. By folding over portions 18, a notch 14 is formed between the flat portion 12 and a tab-like vertical portion 16. By forming tab portion 16 with an angular inner side 17, the notch 14 is formed and provides a receiving area to be discussed below.

Figure 2:
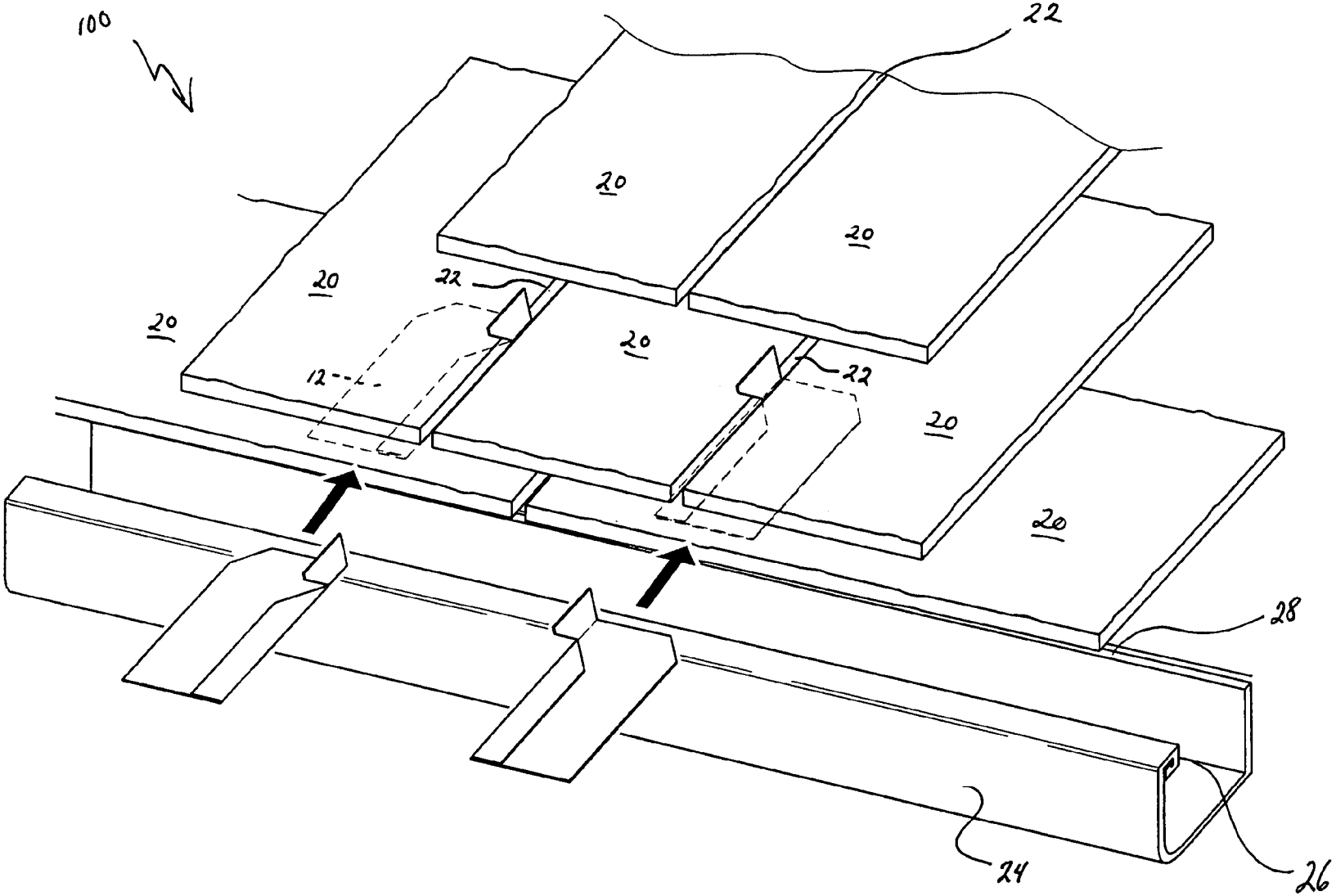
FIG. 2 is a plan view showing the initial steps for installin the roof clips according to an embodiment of the present principles.

Referring to FIG. 2, there is shown a slate roof 100 made up of several slates 20 in the commonly known staggered positions. The slates 20 at the lower most row slightly over hang the rear edge 28 of the gutter 24. Between each slate 20 is a small keyway 22, which due to the irregular edges of the slate shingles 20, also has irregular edges (not showns). The roof clip 12 is positioned such that tab 16 passes up into the keyway 22 and the flat portion 12 is sandwiched between the slate below the keyway 22 and the slate under which flat portion 12 is disposed.

The purpose for the two oppositely sided roof clips 12 is that there are instances when a keyway 22 cannot accommodate a left sided roof clip or a right sided roof clip. For example, the opposite sides can be used on the corresponding ends of the row of shingles where a finished look is required. Alternatively, the different sided roof clips can be selectively used when the flexibility of the roof shingles is greater on one side of the key way 22 as opposed to the other.

Figure 3:
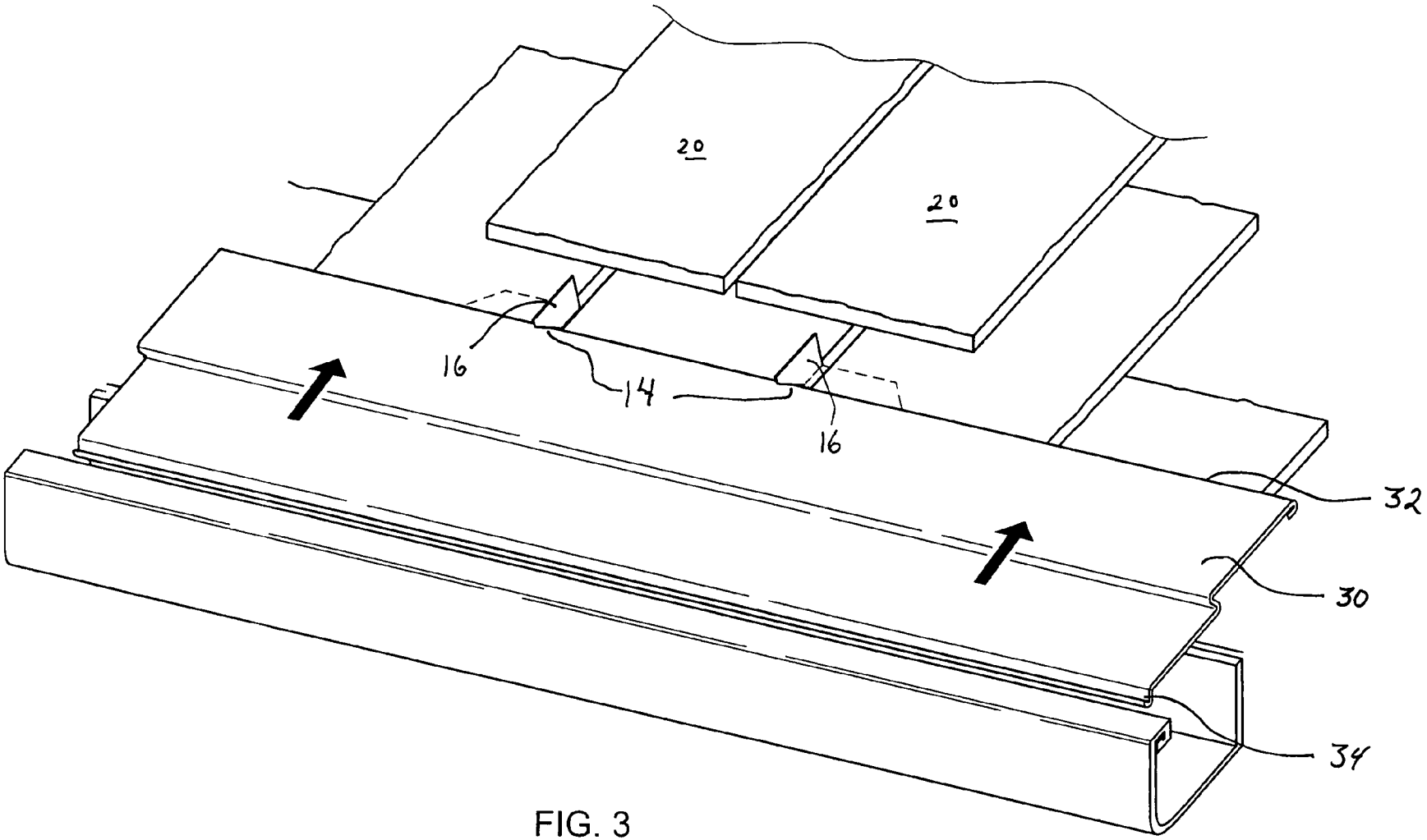
FIG. 3 is a plan view showing another step in the installation of the roof clips according to an embodiment of the present principles.

Once the roof clips 10 are positioned as shown in FIG. 2, a gutter protector 30 can be attached to the slate roof, by positioning the end 32 over the slates 20 such that the end 32 fits within the notch 14 formed by the tab 16 (See FIG. 3). The front edge 34 of the gutter protector is attached to the front edge 26 of the gutter 24 in any known manner.

Figure 4:
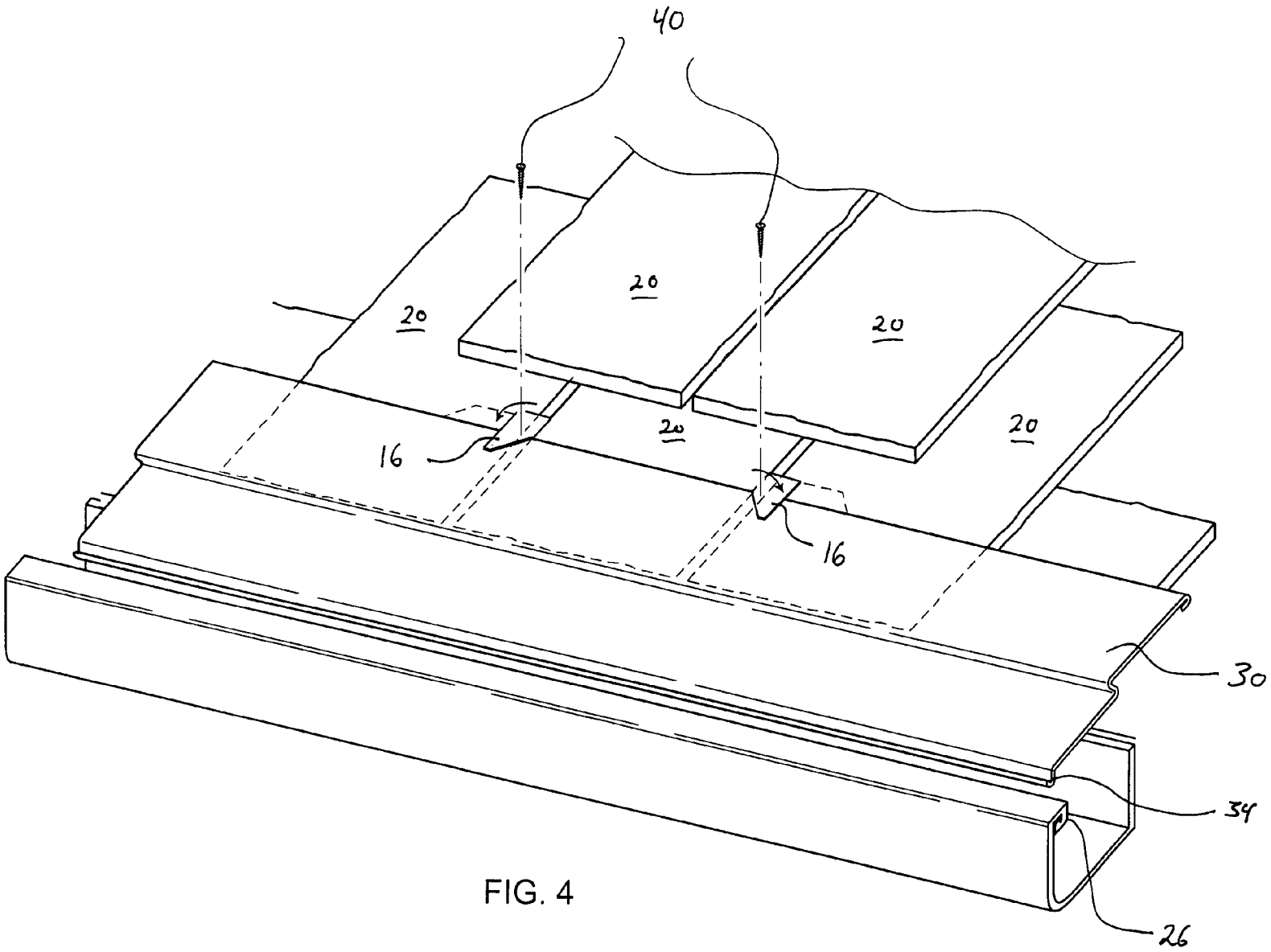
FIG. 4 is a plan view showing another step in the installation of the roof clips according to an embodiment of the present principles.
Figure 5:
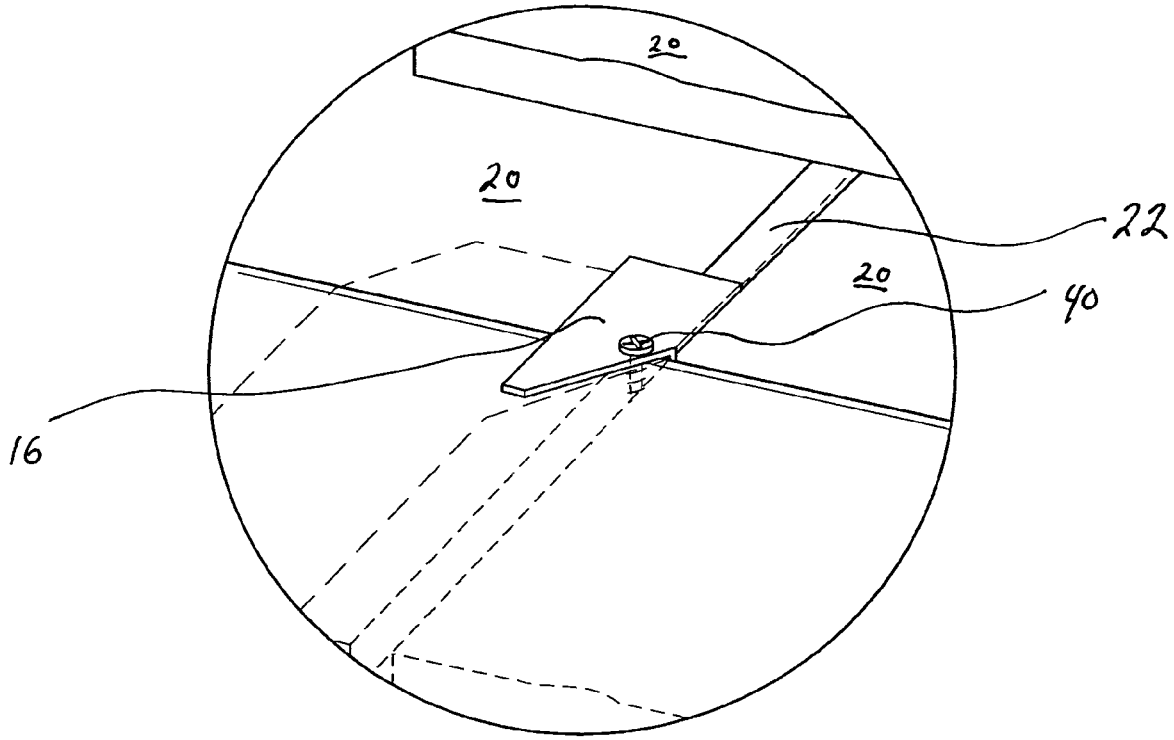
FIG. 5 is magnified portion of the connection portion of the roof clips according to an embodiment of the present principles.

Referring to FIGS. 4 and 5, once the gutter protector is positioned as shown, the tabs 16 can be folded down over the end 32, and small screws 40 can be used to secure the tab portion 16 to the underlying flat portion 12 of the roof clip. In this manner, the roof clip 10 allows the cutter protector to be fastened to the exterior surface of a slate roof, without damaging or otherwise negatively affecting the aesthetics of the slate roof.

The roof clips can be made of any known material, and are preferably made of a metal that is the same as the gutter protector system. For example, aluminum sheet metal would be a good example of such material. Those of skill in the art will recognize that other materials may be used for the roof clips 10, without departing from the spirit of the present principles.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the present principles. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or embodiment of the present principles may be incorporated in any other disclosed, described or suggested form or embodiment as a general matter of design choice. It is the intention, therefore, to be limited only as indicated by the scope of the claims appended hereto.

What is claimed is:

1. A device for connecting a gutter protection system to a roof, the roof having at least two adjacent roof shingles, the device comprising:

a roof clip having a flat portion and a tab portion substantially perpendicularly disposed with respect to said flat portion, said tab portion extending upward through a keyway formed between the at least two adjacent roof shingles and forming a notch aligned with the keyway for receiving an upper end of the gutter protection system.

2. The device according to claim 1, wherein said roof clip further comprises an increased thickness along an edge of the same.

3. The device according to claim 2, wherein said increased thickness is disposed along the edge aligned with said tab portion.

4. The device according to claim 1, wherein said tab portion is secured to the upper end of the gutter protection system.

5. The device according to claim 4, further comprising fastening means for fastening said tab portion to said flat portion through the keyway between adjacent shingles.

6. A method for connecting a gutter protection system to a roof comprising:

inserting a roof clip under two adjacent shingles on a roof, said roof clip having an upward extension positioned in a keyway between the two adjacent shingles;

positioning an upper end of the gutter protection system on top of the roof shingles such that the upper end sits under the upward extension of the roof clip;

securing the upward extension of the roof clip down onto the upper end of the gutter protection system; and inserting a fastener into the upward extension, through the upper end of the gutter protector and into a base of said roof clip.

* * * * *